US007445527B1

(12) United States Patent
Carr

(10) Patent No.: US 7,445,527 B1
(45) Date of Patent: Nov. 4, 2008

(54) ELECTRICAL CONNECTOR, ENTRANCE GUIDE THEREFOR AND METHODS OF MAKING THE SAME

(76) Inventor: James E. Carr, 23700 Green Hills Road, Lebanon, MO (US) 65536

( * ) Notice: Subject to any disclaimer, the term of this patent is extended or adjusted under 35 U.S.C. 154(b) by 0 days.

(21) Appl. No.: 11/789,938

(22) Filed: Apr. 26, 2007

(51) Int. Cl.
*H01R 4/36* (2006.01)

(52) U.S. Cl. ..... 439/814

(58) Field of Classification Search ..... 439/814, 439/810, 812, 224, 784, 790, 217
See application file for complete search history.

(56) References Cited

U.S. PATENT DOCUMENTS 3,228,094 A 1/1966 Stanback et al.
3,638,173 A 1/1972 Middledorf et al.
D309,129 S 7/1990 Ottmann
4,946,405 A 8/1990 Boehm
5,199,905 A 4/1993 Fillinger
5,533,913 A * 7/1996 Boehm et al. ..... 439/810
5,957,733 A * 9/1999 Mello et al. ..... 439/814
6,203,384 B1 3/2001 DeFrance
6,213,818 B1 * 4/2001 Chadbourne ..... 439/810
6,497,592 B1 * 12/2002 Beadle ..... 439/814
6,579,131 B1 6/2003 Ashcraft et al.
D487,062 S 2/2004 Foster

* cited by examiner

*Primary Examiner*—Jean F Duverne
(74) *Attorney, Agent, or Firm*—Richard L. Marsh

(57) ABSTRACT

An electrical terminal connector has a wire receiving opening disposed through a body member thereof, the wire receiving opening having a defined guiding surface provided on an insertion side of the body member. The defined guiding surface is tangent to the wire receiving opening.

17 Claims, 3 Drawing Sheets

ELECTRICAL CONNECTOR, ENTRANCE GUIDE THEREFOR AND METHODS OF MAKING THE SAME

BACKGROUND OF THE INVENTION

1. Field of the Invention

This invention relates to an electrical terminal connector having a bearing surface and a guiding surface on a wire receiving end, the bearing surface and guiding surface cooperating to facilitate insertion of a conductor into the electrical connector.

2. Prior Art Statement

It is known to provide holes in a terminal block that have a groove at the bottom of a larger wire receiving opening for accepting a smaller wire in the groove. For instance, see the U.S. Pat. No. 3,228,094 issued on Jan. 11, 1966, to Stanback, et al., or the U.S. Pat. No. 3,638,173 issued on Jan. 25, 1972 to Middendorf, et al. In either patent, the larger wire receiving opening does not have a bearing surface or a defined guiding surface for facilitating the insertion of a conductor into the wire receiving opening. It has been found by the inventor of the instant invention that the groove for the smaller wire can catch a strand of a conductor and thus hinder the insertion of the conductor into the larger wire receiving opening. Therefore, there is a great need for an electrical terminal connector that has a bearing surface for receiving a cut end of a conductor thereupon and at least one wire guiding surface defined into the connector wherein the wire guiding surface is disposed tangent to at least a portion of a wire receiving opening.

It is also known to provide a chamfer on the input side of the stud mount opening for connecting a terminal block to a transformer, however, there is no chamfer on the conductor ports to facilitate insertion of the conductor thereinto. For instance, see the U.S. Pat. No. 6,579,131 issued on Jun. 17, 2003 to Ashcraft, et al. Accordingly, there is still a need for an electrical terminal connector that has at least one wire guiding surface defined into the wire receiving opening.

It is further known to provide a polygonal opening in an electrical connector for a conductor, however, no bearing surface or guiding surface is provided. For instance, see U.S. Pat. D 487,062 S issued on Feb. 24, 2004 to Gary D. Foster. The polygonal opening creates numerous sharp edges which catch strands of a conductor thus hindering insertion of the conductor into the opening. Thus, there remains a need for an electrical terminal connector that at least has a wire guiding surface tangent to at least a portion of a wire receiving opening.

Additionally, it is known to provide a pedestal connector bar that has a plurality of lay-in openings for receiving distribution cables. Each lay-in opening has an oblique entry channel and a semicircular bottom wherein the cables are secured against the semicircular bottom by a set screw disposed through one wall of the oblique entry channel. For instance, see U.S. Pat. No. 5,199,905 issued on Apr. 6, 1993 to David R. Fillinger or the U.S. Pat. No. 6,203,384, issued on Mar. 20, 2001 to Robert DeFrance. The oblique entry channel is effective for insertion of the side edge of the cable, however, no improvement is shown for insertion of the cut end of the cable. In fact, the Fillinger patent teaches that insertion of the cut end of the cable into a round hole without a facilitating entry port remains from the prior art. Hence, there still is a need for an electrical terminal connector that has at least a wire guiding surface tangent to at least one portion of a wire receiving opening.

Finally, it is known to provide an electrical connector that comprises a body and an elongated tang, the body having upper, central and lower portions. A wire receiving opening is disposed through the central body and terminates in the tang. A set screw is disposed through the upper body portion to clamp the wire into the opening. The central body portion is claimed to be smaller than the set screw to allow the clamped conductor to expand beyond the edges of the central portion to increase the clamping force. For instance, see the U.S. Pat. No. 4,946,405 issued on Aug. 7, 1990 to William J. Boehm, or the U.S. Pat. D 309,129 issued on Jul. 10, 1990 to David M. Ottmann. Since the central body portion is made smaller than the set screw, a channel exists at the wire receiving opening, however, a close inspection of the patent shows that Boehm and Ottmann teach that the bottom of the channel is disposed below the wire receiving opening thus creating another sharp edge to catch a strand of a conductor thereupon. Consequently, there continues to be a great need for an electrical terminal connector that has at least a wire guiding surface tangent to at least one portion of a wire receiving opening.

SUMMARY OF THE INVENTION

Another object of this invention is to provide an electrical terminal connector that has a wire receiving hole disposed through a body member thereof, the wire receiving hole having a defined guiding surface provided on an insertion side of the body member, the defined guiding surface tangent to the wire receiving hole.

A primary goal of this invention is to provide an electrical terminal connector that has a wire receiving hole disposed through a body member thereof, the wire receiving hole having a defined guiding surface provided on an insertion side of the body member, the defined guiding surface tangent to the wire receiving hole and defined by a first column extending from the wire receiving opening toward a top surface of the body member.

A main purpose of this invention is to provide an electrical terminal connector that has a wire receiving hole disposed through a body member thereof, the wire receiving hole having a defined guiding surface provided on an insertion side of the body member, the defined guiding surface tangent to the wire receiving hole and defined by a first column extending from the wire receiving opening toward a top surface of the body member and a second column extending toward a top surface of the body member from an opposed portion of the wire receiving opening where the second column is also tangent to the wire receiving opening.

A principal aim of this invention is to provide an electrical terminal connector that has a wire receiving hole disposed through a body member thereof, the wire receiving hole having a defined guiding surface provided on an insertion side of the body member, the defined guiding surface tangent to the wire receiving hole and extending thereaway from and constituting one wall disposed at an acute angle with respect to an opposite wall tangent to the wire receiving hole and extending thereaway from, the one wall and the opposite wall thus defining a slot extending from a base curve of the wire receiving opening toward the top surface. The acute angle may be up to about 60 degrees but preferably is about 30 degrees.

A significant feature of this invention is to provide an electrical terminal connector that has a wire receiving hole disposed through a body member thereof, the wire receiving hole having a defined guiding surface provided on an insertion side of the body member, the defined guiding surface tangent to the wire receiving hole and defined by a wall disposed at an acute angle with respect to an opposite wall of a slot disposed at the wire insertion end of the body member.

A primary principle of this invention is to provide an electrical terminal connector comprises a tang and body member, the body member having a wire opening disposed therethrough from a wire receiving end thereof through to a tang end thereof, the body member further having a setting screw hole disposed through the body member from a top surface thereof, the setting screw hole intersecting with the wire opening and extending into a base of the body member, the wire receiving end of the body member defining a wire receiving opening, the wire receiving end of the body having at least one wire guiding surface defined thereinto, the wire guiding surface disposed tangent to at least a portion of the wire receiving opening.

A primary aspect of this invention is to provide an electrical terminal connector that comprises a tang and a body member, the body member having a wire hole disposed therethrough from a wire receiving end thereof through to a tang end thereof. The body member further has a setting screw hole disposed through the body member from a top surface thereof, the setting screw hole intersecting with the wire hole and extending into a base of the body member. The wire receiving end of the body member is further defined by a wire receiving opening, the wire receiving end of the body member comprising an extension extending outwardly from a rear face of the body member, the extension having a bearing surface co planar with a lower portion of the wire hole. The extension may comprise at least one tapered wall extending inwardly and downwardly from the top surface of the body member, the tapered wall disposed at a half angle with respect to a vertical centerline of the connector. The half angle may be disposed relative to the vertical centerline at an angle of up to 30 degrees.

It is another principal aspect of this invention to provide an electrical connector comprising a body member and a tang, the body member comprising an extension extending outwardly from a rear face of the body member, the extension having a bearing surface co planar with a lower portion of the wire hole. The extension may comprise one tapered wall extending inwardly and downwardly from the top surface of the body member, the tapered wall disposed at an angle with respect to a vertical centerline of the connector and a second tapered wall disposed opposite the one tapered wall, the second tapered wall disposed at an angle with respect to the vertical centerline of the connector. The angle is preferably disposed relative to the vertical centerline at an angle of up to 30 degrees. The angle of each wall with respect to the centerline may be equal and the total angle between the one tapered surface and the second tapered surface is preferably less than 60 degrees.

DESCRIPTION OF THE PREFERRED EMBODIMENTS

While the various features of this invention are hereinafter described and illustrated as an electrical terminal connector that has a wire receiving hole disposed through a body member thereof wherein the wire receiving hole has a defined guiding surface provided on an insertion side of the body member and the defined guiding surface is tangent to the wire receiving hole, it is to be understood that the various features of this invention can be used singly or in various combinations thereof for an electrical terminal connector as can hereinafter be appreciated from a reading of the following description.

Figure 1:
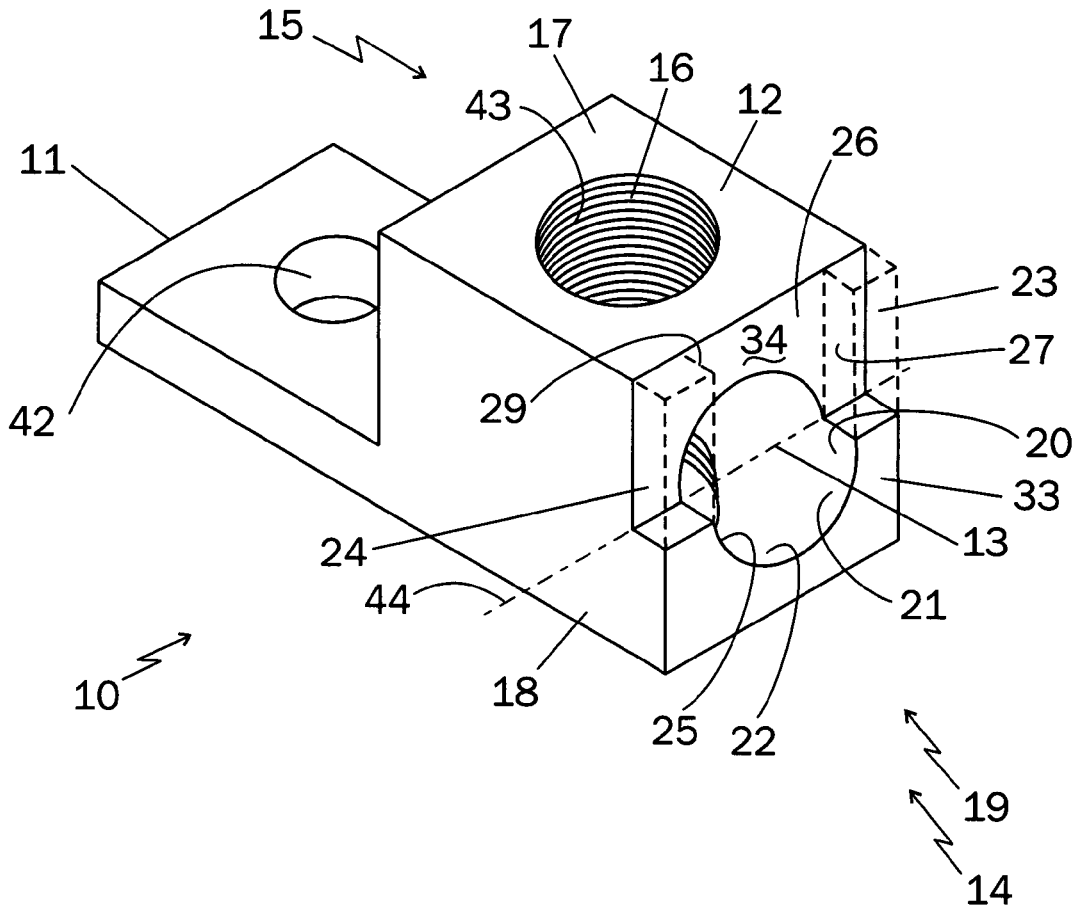
FIG. 1 is a perspective view of an embodiment of the electrical connector of this invention showing a guiding surface on a receiving end of the connector.

Referring now to FIG. 1, an electrical terminal connector, generally depicted by the numeral 10, comprises a tang 11 and a body member 12, body member 12 having a wire hole 13 disposed therethrough from a wire receiving end 14 thereof through to a tang end 15 thereof. Body member 12 further has a setting screw hole 16 disposed through body member 12 from a top surface 17 thereof, setting screw hole 16 intersecting with wire hole 13 and extending into a base 18 of body member 12. Preferably, tang 11 and body member 12 are integral and therefore base 18 is indistinguishable from tang 11, however, body member 12 may be formed separately from tang 11 and joined thereto in a separate operation wherein body member 12 extends above tang 11 as is described in at least the aforementioned U.S. Pat. No. 3,638,173. Wire receiving end 14 of body member 12 is further defined by a wire receiving opening 19, wire receiving end 14 of body member 12 comprising an extension 33 extending outwardly from a rear face 34 of body member 12, extension 33 having a bearing surface 22 co planar with a lower portion 35 of wire hole 13 and at least one wire guiding surface 20 defined thereinto, wire guiding surface 20 preferably disposed tangent to at least a portion 21 of wire receiving opening 19. Typically, the conductor is inserted into wire hole 13 along an axis 46 from a position adjacent rear face 34. It has been found by the inventor hereof that cut ends of conductors often have splayed strands or burrs on the ends of the strands which are easily caught on rear face 34 of the conventional connector described in the prior art. Using connector 10 of this invention, the conductor is aligned parallel with axis 46 but spaced above connector 10 such that the end of the conductor may be inserted onto wire guiding surface. Since it is also difficult to insert a conductor of approximately the same size as wire hole 13 into wire hole 13, bearing surface 22 and guiding surface 20 of extension 33 are provided to accept a cut end of a conductor (not shown) therein to reform a terminal end of the conductor by twisting the conductor against guiding surface 20 and pushing the conductor into wire hole 13 thus facilitating insertion of the conductor into wire hole 13. Once inserted into and fully seated in wire hole 13, a set screw (not shown) is threaded into setting screw hole 16 and tightened against the conductor thus securing the conductor to connector 10. It has been found by the inventor hereof that extension 33 with bearing surface 22 and wire guiding surface 20 of electrical connector 10 may be provided in a number of forms while maintaining the function thereof. For instance, wire guiding surface 20 may additionally be defined by a first wall 27 of a column 23 extending upwardly from extension 33 toward top surface 17 of body member 12, wire guiding surface 20 further disposed on column 23 tangent to wire receiving opening 19. Column 23 may extend upwardly from wire receiving opening a short distance though it is within the scope of this invention to extend first column to a length as desired including extending column 23 to top surface 17 of body member 12 as shown in dashed lines.

Preferably, electrical connector 10 has a second column 24, shown in dashed lines, extending upwardly from extension 33 from a portion 25 of wire receiving opening 19 opposite portion 21, second column 24 having a wall 29 also tangent to portion 25 of wire receiving opening 19. As with column 23, column 24 extends upwardly toward top surface 17 a desired distance, though column 24 may also extend to top surface 17. Column 23 and column 24 are then used to capture a stranded conductor therebetween, resting the conductor on bearing surface 22, and by twisting the conductor, the strands of the conductor are formed into a circular mass, the conductor may be easily inserted into wire hole 13. It should be readily apparent that first and second columns 23, 24 thus define a slot 26 extending from bearing surface 22 of wire receiving opening 19 toward top surface 17. Though columns 23, 24 are shown in dashed lines, it is fully understood that columns 23, 24 may be extended from their respective points of tangency upward any desired distance, including the full distance to top surface 17. Of course, columns 23, 24 may be further extended above top surface 17, however, it shall become readily apparent that additional extension is unnecessary.

Figure 2:
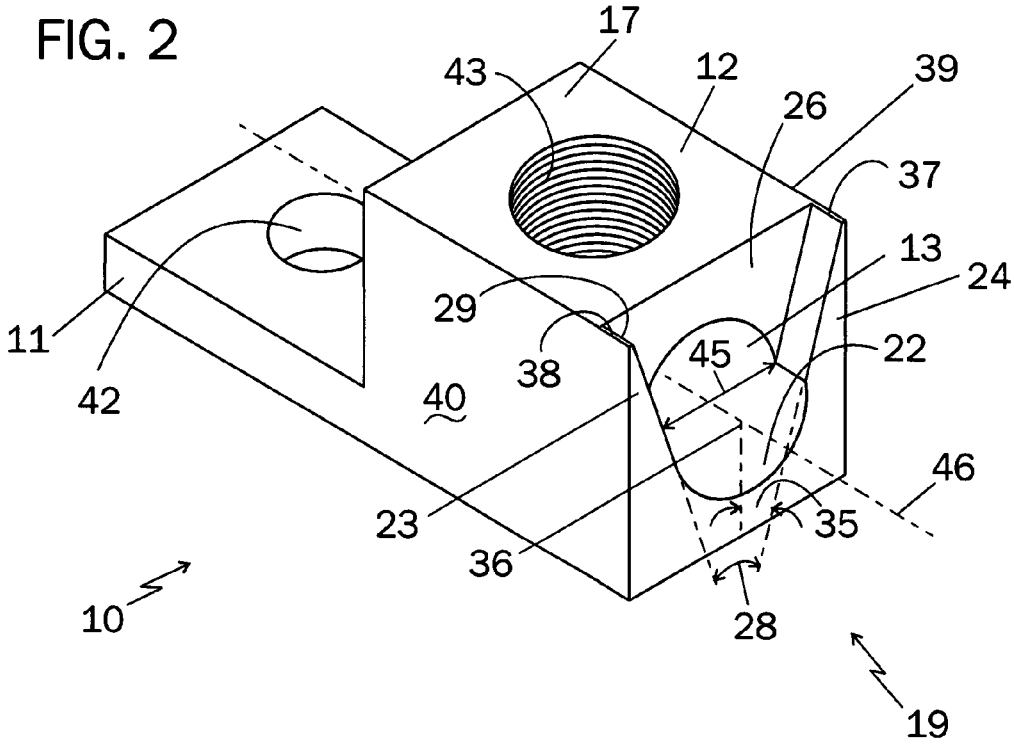
FIG. 2 is an alternate electrical connector of this invention.

Referring now to FIG. 2, electrical connector 10 may have wall 27 of slot 26 tapered, wall 27 of column 23 preferably disposed at an acute angle 28 with respect to an opposite wall 29 of column 24. Both walls 27, 29 are shown angled to substantially the full extent above bearing surface 22, however, either wall 27 or 29 may be vertical above the point of tangency. Also, though both walls 27, 29 are shown extending from the point of tangency with bearing surface 22 fully to top surface 17, either, or both of walls 27, 29 need not extend beyond a length necessary to accomplish the purposes of this invention. Those skilled in the art of electrical connections will fully appreciate that tapering of slot 26 further facilitates entry and reformation of a stranded conductor when inserting the conductor into wire hole 13 and thus, recognize that it is not necessary to re-cut an end of an existing conductor when replacing same into wire hole 13, whether the conductor is being reinserted into an installed electrical connector 10 of this invention or inserted into a new electrical connector 10 of this invention. In the preferred embodiment acute angle 28 is up to about 60 degrees, acute angle 28 equally split between wall 27 and wall 29. However, as hereinbefore stated only one wall 27, 29 need be tapered to fully realize the function of guiding surface 20 of this invention and thus, when only one wall 27, 29 is tapered, acute angle 28 will generally be less than 60 degrees. It should also be fully understood that the angle between walls 27, 29 may be less than 60 degrees and that only one wall 27 or 29 may be disposed at a half angle 35, half angle 35 measured from a vertical centerline 36 of wire hole 13 of connector 10. Angle 28 is generally limited by the width and height of body member 12 though it is fully within the scope of this invention to terminate column 23 and/or 24 at less than the full height of body member 12 and dispose half angles 35 at a greater angle so that the terminus 37, 38 respectively of walls 27, 29 is coincident with side surfaces 39, 40 respectively of body member 12.

Figure 3:
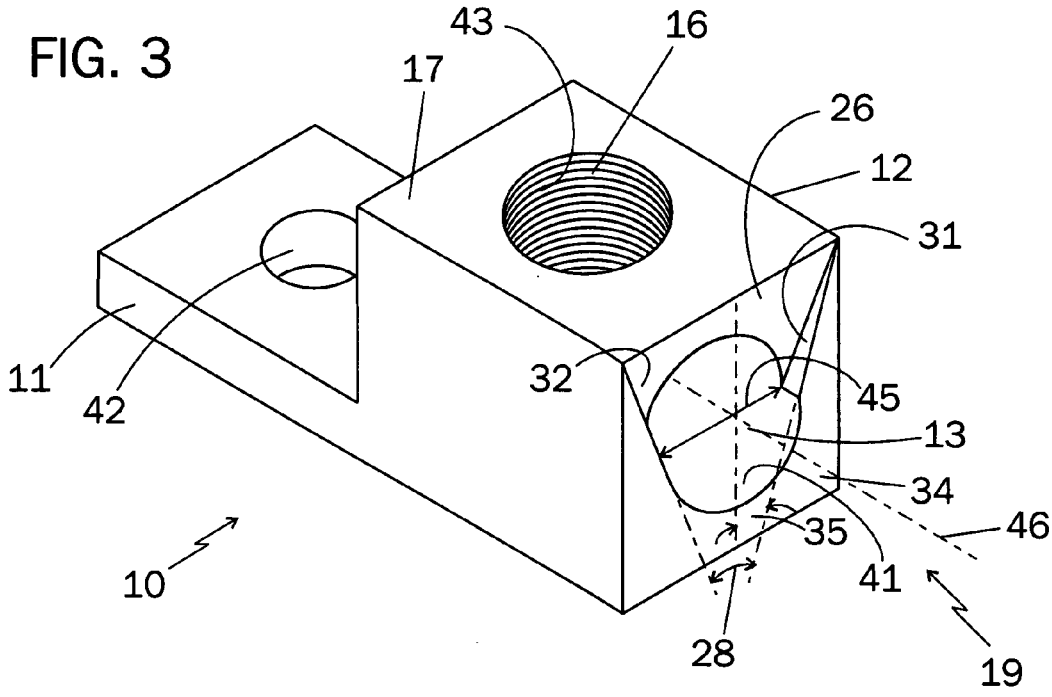
FIG. 3 is another alternate electrical connector of this invention.

Referring now to FIG. 3, slot 26 may be disposed into a rear face 34 of electrical connector 10 and tapered from rear face 34 inwardly and downwardly along tapered surfaces 31, 32. As with walls 27, 29 of FIGS. 1 and 2, tapered surfaces 31, 32 may extend fully to top surface 17 as shown in FIG. 3, however, tapered surfaces 31, 32 may either or both terminate at a point below top surface 17. Furthermore, it is fully within the scope of this invention to provide only tapered surface 31 or tapered surface 32. Tapered surfaces 31, 32 are tangent to wire hole 13 at wire opening 19 thus establishing a bearing surface 41 upon wire opening 19, bearing surface 41 receiving the cut end of a conductor thereupon. As with electrical connector 10 of FIGS. 1 and 2, the conductor is rested upon bearing surface 41, the conductor is rotated to reform the strands of the conductor into a circular mass by bearing the strands against tapered surface 31 and/or 32, wherein the conductor may be easily inserted into wire hole 13. An angle 35 defines a downwardly extending portion of tapered surfaces 31 with respect to vertical centerline 35 while angle 28 defines the total angle between downwardly extending portions of tapered surfaces 31 and 32. Angle 28 is preferably less than 60 degrees, however, it is fully within the scope of this invention to produce angle 28 as desired to accomplish the purposes of this invention.

Base 18, body member 12, extension 33 and tang 11 are preferably integral units and are preferably formed by extruding aluminum in a direction normal to vertical axis 36 and normal also to wire hole 13 thus forming body portion 12 and tang 11 simultaneously. An anchor hole 42 may be punched through tang 11 through anchor hole 42 is preferably drilled therethrough in the machining operations along with wire hole 13 and setting screw hole 16. The extruded bar is preferably inserted into a computer controlled machine which drills wire hole 13 and setting screw hole 16 through body member 12 and anchor hole 42 though tang 11, setting screw hole 16 subsequently tapped to form threads 43 therein. Threads 43 extend fully through setting screw hole 16 and extend into base 18 as shown in the drawings. Bearing surface 22 and portions 21, 25 of wire receiving opening 19 may be established by removing an upper portion (not shown) of extension 33 from top surface 17 at rear face 34 downwardly to a transverse centerline 44 of wire hole 13. It is preferred, however, that at least wall 27 be established tangent to portion 21 thus establishing slot 26. Wall 27 may extend vertically upwardly from transverse centerline 44 but preferably is angled upwardly and outwardly from portion 21 of wire receiving opening 19 thus establishing tapered wall 37. Wall 29 may similarly be extended vertically upwardly from transverse centerline 44 but also preferably is angled upwardly and outwardly from portion 25 of wire receiving opening 19 thus establishing tapered wall 38. Upon completion of the machining operations, electrical connector 10 is then cut at side surfaces 39, 40 into the defined proper width ready for use by electrical cable installers. Though electrical connector 10 is preferably formed by extruding an aluminum bar into the proper shape, electrical connector 10 may be forged or die cast from aluminum wherein anchor hole 42, wire hole 13 and setting screw hole 16 are formed by inserts in the mold whereafter threads 43 are formed in setting screw hole 16 in a subsequent machining operation. Connector 10 may have a reduced width 45 formed above wire hole 13 to assist the user of connector 10 to reform an end of the conductor while inserting the conductor into wire hole 13. For instance, wire receiving opening 19 and wire guiding surface 20, including walls 27, 29 of wire guiding surface 20 may be disposed closer than a distance equal to the diameter of wire hole 13 as shown as wall 27 in FIG. 2 through both wall 27 and wall 29 converge above centerline 44 of wire hole 13. As described above, the conductor is usually moved axially into wire hole 13, and when individual strands of the conductor at the end thereof are splayed outwardly, insertion of the conductor axially into wire hole 13 is difficult. By aligning the conductor parallel to axis 46 and moving the conductor perpendicular to axis 46 onto wire guiding surface 20, the splayed ends of the conductor may be slightly compressed as the end of the conductor is inserted into reduced width 45 between walls 27, 29 of wire receiving opening 19. As the conductor is usually not smaller in diameter than reduced width 45, the conductor cannot move in a direction perpendicular to axis 46 once the conductor has passed through reduced width 45. Likewise, in FIG. 3, either, or both tapered surfaces 31, 32 may be disposed closer to vertical centerline 36 thus creating reduced width 45 to further facilitate insertion of the conductor into wire hole 13 thus containing the conductor onto bearing surface 22 and within wire receiving opening 19. Therefore, by turning the conductor while resting on bearing surface 22 of wire receiving opening 19, the conductor may then be easily inserted axially into wire hole 13.

Figure 4:
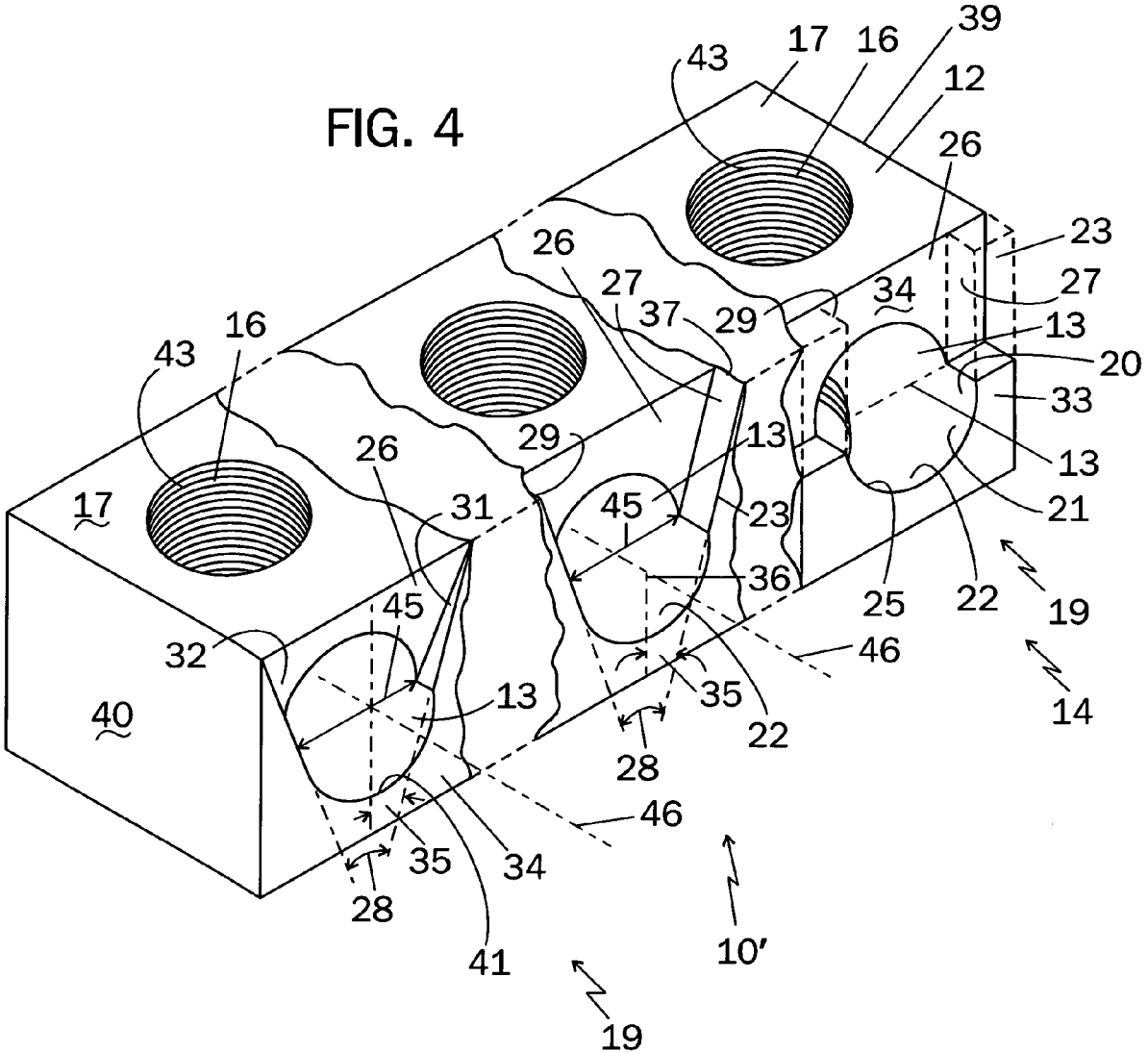
FIG. 4 is a perspective view of a bar connector embodying the teachings of this invention.

Referring now to FIG. 4, connector 10 may be a bar connector 10' of indeterminate length, bar connector 10' having at least one wire hole 13 disposed therethrough. Generally, bar connector 10' has a plurality of wire holes 13 disposed therethrough, each wire hole 13 of the bar connector 10' provided with an intersecting set screw hole 16. Wire holes 13 of bar connector 10' are preferably provided with wire receiving openings 19 of any of the configurations described above in FIGS. 1-3 and may have all of the above configurations resident in a single bar connector 10'. Those skilled in the art will readily recognize that bar connector 10' does not have tang portion 11 described above, but rather is mounted at either side surface 39, 40, captured in a mounting slot (not shown) or affixed through at least one mounting hole provided in base 18.

While the present invention has been described with reference to the above described preferred embodiments and alternate embodiments, it should be noted that various other embodiments and modifications may be made without departing from the spirit of the invention. Therefore, the embodiments described herein and the drawings appended hereto are merely illustrative of the features of the invention and should not be construed to be the only variants thereof nor limited thereto.

I claim:

1. An electrical terminal connector comprises a tang and body member, said body member having a wire opening disposed therethrough from a wire receiving end thereof through a tang end thereof, said body member further having a setting screw hole disposed through said body member from a top surface thereof, said setting screw hole intersecting with said wire opening and extending into a base of said body member, said wire receiving end of said body member defining a wire receiving opening, said wire receiving end of said body having at least one wire guiding surface defined into a rear face of said body member, said at least one wire guiding surface disposed tangent to at least a portion of said wire receiving opening, said wire guiding surface extending upwardly from a point of tangency with said wire receiving opening along said rear face toward a top surface of said body member.

2. An electrical connector as in claim 1 wherein said at least one wire guiding surface is defined by a first column extending from said wire receiving opening toward a top surface of said body member.

3. An electrical connector as in claim 2 wherein said first column extends to said top surface of said body member.

4. An electrical connector as in claim 3 wherein a second column extends from an opposed portion of said wire receiving opening, said second column tangent to said wire receiving opening.

5. An electrical connector as in claim 4 wherein said first and said second column define a slot extending from a base curve of said wire receiving opening toward said top surface.

6. An electrical connector as in claim 5 wherein said slot has one said wire guiding surface disposed at an acute angle with respect to an opposite wire guiding surface of said slot.

7. An electrical connector as to claim 6 wherein said acute angle is up to about 60 degrees.

8. An electrical terminal connector has a wire receiving opening disposed through a body member thereof, said wire receiving opening having a defined guiding surface provided into a rear face of an insertion side of said body member, said defined guiding surface tangent to said wire receiving opening, said at least one wire guiding surface defined by a tapered wall extending from said wire receiving opening toward a top surface of said body member, said tapered wall extending to said top surface of said body member end wherein a second tapered wall extends from an opposed portion of said wire receiving opening, said second tapered wall tangent to said wire receiving opening.

9. An electrical connector as in claim 8 wherein said first and said tapered walls define a slot extending from a base curve of said wiring receiving opening toward said top surface.

10. An electrical connector as in claim 9 wherein said slot has one wall disposed at an acute angle with respect to a central axis of said electrical connector.

11. An electrical connector as in claim 10 wherein said acute angle is up to about 30 degrees.

12. An electrical terminal connector comprises a tang and a body member, said body member having a wire hole disposed therethrough from a wire receiving end thereof through a tang end thereof, said body member further having a setting screw hole disposed through said body member from a top surface thereof, said setting screw hole intersecting with said wire hole and extending into a base of said body member, said wire receiving end of said body member further defined by a wire receiving opening, said wire receiving end of said body member comprising an extension extending outwardly from a rear face of said body member, said extension having a bearing surface co-planar with a lower portion of said wire hole.

13. An electrical connector as in claim 12 wherein said extension has at least one tapered wall extending inwardly and downwardly from a top surface thereof wherein said downwardly extending portion of said tapered wall is disposed at an angle with respect to a vertical centerline of said connector.

14. An electrical connector as in claim 13 wherein said angle is disposed relative to said vertical centerline at an angle of up to 30 degrees.

15. An electrical connector as in claim 13 wherein said extension has a second tapered wall disposed opposite said one tapered wall wherein said downwardly extending portion of said second tapered wall is disposed at another angle with respect to said vertical centerline of said connector.

16. An electrical connector as in claim 15 wherein said another angle is disposed relative to said vertical centerline at an angle of up to 30 degrees.

17. An electrical connector as in claim 16 wherein a total angle between said one tapered wall and said second tapered wall is less than 60 degrees.

* * * * *